United States Patent [19]

Fujino et al.

[11] 4,392,738

[45] Jul. 12, 1983

[54] IMAGE TRANSFER DEVICE

[75] Inventors: Hitoshi Fujino, Yokohama; Masanobu Kanoto; Hiroo Ichihashi, both of Tokyo, all of Japan

[73] Assignee: Canon Kabushiki Kaisha, Tokyo, Japan

[21] Appl. No.: 342,367

[22] Filed: Jan. 25, 1982

Related U.S. Application Data

[63] Continuation of Ser. No. 89,454, Oct. 30, 1979, abandoned.

[30] Foreign Application Priority Data

Nov. 10, 1978 [JP] Japan ..... 53-138439
Dec. 26, 1978 [JP] Japan ..... 53-164148

[51] Int. Cl.[3] ..... G03G 15/14
[52] U.S. Cl. ..... 355/3 TR; 355/3 R
[58] Field of Search ..... 355/3 R, 3 BE, 3 TR, 355/14 TR

[56] References Cited

U.S. PATENT DOCUMENTS 3,685,896 8/1972 Kaupp ..... 355/3 TR
3,914,042 10/1975 Watson ..... 355/3 TR
4,131,358 12/1978 Windele ..... 355/3 TR
4,213,551 7/1980 Windele ..... 355/3 TR X

*Primary Examiner*—Fred L. Braun
*Attorney, Agent, or Firm*—Fitzpatrick, Cella, Harper & Scinto

[57] ABSTRACT

An image transfer device in an image forming apparatus is generally constructed with a recording element as an intermediate recording medium to hold thereon an image to be transferred onto an image transfer material. An image transfer device transfers the image from the recording element to the image transfer material and a guiding device guides the image transfer material which is capable of setting a position from the recording element in accordance with a kind of the image transfer material used. An image transfer material conveying device conveys the image transfer material through the recording element and the image transfer device and driving device displaces the guiding device in the direction away from the recording element at the time of non-operation of the image transfer material conveying device.

2 Claims, 8 Drawing Figures

IMAGE TRANSFER DEVICE

This is a continuation, of application Ser. No. 89,454, filed Oct. 30, 1979, now abandoned.

BACKGROUND OF THE INVENTION

1. Field of the Invention

This invention relates to an image forming device which utilizes a continuous web of image transfer material such as fanfold paper, rolled paper, and the like. More particularly, the invention is concerned with an image transfer device in such image forming apparatus, by which an image such as an electrostatic or magnetic latent image, toner image, and so forth formed on a recording element in the image forming apparatus such as a photosensitive drum, an insulative/electrically conductive drum, etc. is transferred onto an image transfer material such as paper, etc.

2. Description of the Prior Art

As the image forming apparatus using a continuous web of image transfer material, there have so far been put into practice various kinds of recording devices, in which the electrophotographic method and the magnetization method are applied. For instance, there is a recording device which performs the recording operations by irradiating a modulated laser beam onto an ordinary electrophotosensitive material. This type of recording device first modulates light quantity of the laser beam by an output data from a computer, etc., then focuses this modulated laser beam onto the surface of a drum-shaped photosensitive member (hereinafter simply called "drum") as an information recording element by means of a scanning means such as a rotatory mirror, etc., and scans the focused image for exposure. The drum, through various electrophotographic processes, is subjected to the light exposure by the abovementioned laser beam, and forms thereon an electrostatic potential image. This electrostatic image is then developed by toner to render it visible, after which the visible image is transferred onto an image transfer material, followed by further heating or pressure application to fix the image or the image transfer material, thereby attaining the image recording.

The image recording device of the abovementioned type is capable of high speed printing on account of its absence of a mechanical printing section as in conventional line printers, hence it provides an improved non-impact type printer of high image quality and low noise.

Generally, the image transfer device which transfers a toner image onto an image transfer material is constructed with a corona discharger having excellent image transfer efficiency, and a guide plate which guides a predetermined image transfer material into a predetermined feeding path. The corona discharger is disposed in confrontation to the drum at the center of the image transfer section, while the guide plate is disposed at a position where the image transfer material becomes able to contact the drum on its tangential line at the center of the image transfer section. By always maintaining constant the distance between the surface of the drum and the surface of the image transfer material on the guide plate, the image transfer material is able to travel stably along the guide member, whereby a transferred (or reproduced) image of high transfer efficiency and high image quality can be obtained. If the distance between them becomes inappropriate, the state of contact between the image transfer material and the photosensitive drum lacks stability with the consequence that not only the image transfer efficiency and the image quality lower, but also, when the drum and the guide plate get into strong frictional contact through the image transfer material, they will become mutually impaired, or the image transfer material is damaged to interrupt the recording operation. Accordingly, it is indispensable that the distance between the drum surface and the surface of the image transfer material be maintained constant all the time.

Incidentally, it is usual that the guide plate to guide the image transfer material has some errors in its mechanical precision due to cylindrically and rectilinearity derived from the manufacturing errors, or owing to non-uniformity in working during the manufacturing steps. It has been contemplated to minimize such defects in the manufacture by increasing the working precision, which however accompanies real difficulties due to requirement for high degree of expertise in the working technique and prohibitive increase in the manufacturing cost. Therefore, demands has been continuing for a mechanism to supplement the defects in the mechanical precision of the guide plate without necessity for high degree of working technique and prohibitive increase in the manufacturing cost.

By the way, thickness of the image transfer material in the form of a continuous web of paper to be used for such image forming apparatus is standardized by a weight indication usually called "basis weight". For example, there are six kinds of paper thickness for the image transfer material to be used for general recording devices, which ranges from the thinnest one of 45 kg in basis weight to the thickest one of 135 kg in basis weight. Converting these basis bulk weight measurements to their respective paper thickness in metric system, they range from 0.068 mm to 0.190 mm. It is therefore necessary that these kinds of paper be conveyed in a predetermined state of contact with the drum so that a reproduced image of good quality may always be obtained, when they are used as the image transfer material. In more detail, in order to enable the image transfer material having at least six kinds of thickness to contact the drum on the tangential line thereof, there becomes necessary to provide a mechanism capable of varying the distance between the surface of the drum and the surface of the image transfer material to be guided by the guide plate in accordance with thickness of the image transfer material to be used.

Further, in the non-impact printer of the abovementioned construction, it is necessary that the image transfer material guided by the guide plate be in contact with the drum surface at the time of the image transfer during a period of from start of the recording operations by the device until its stoppage, i.e., while the image transfer material is being conveyed to the drum, and that it be separated from the drum surface outside the image transfer operation, i.e., when the image transfer material is not conveyed. If such operation is to be done by the guide plate, the plate is required, as its condition for forming reproduced image of high quality, to have sufficient response to the operating surface running stably and an extremely high speed.

SUMMARY OF THE INVENTION

It is an object of the present invention to provide an improved image transfer device which is capable of handling continuous web of image transfer material, and which solves various points of problems in the working precision with the conventional guide means.

It is another object of the present invention to provide guide means having high precision without use of a particularly high degree of working technique.

It is still another object of the present invention to provide an image transfer device which enables use of image transfer materials of differing thicknesses so that the image transfer material may always be in contact with the recording element in a certain definite state irrespective of the thickness of the image transfer material.

With a view to attaining the abovementioned objects, the image transfer device according to the present invention is constructed with guide means to guide the image transfer material to the recording element, and drive means to move the guide means relative to the recording element so as to arbitrarily set a distance between the guide means and the image transfer material.

A concrete construction of the abovementioned guide means is such that it has a pivotal point for oscillation at the far side from the recording element, an oscillating end at the near side of the recording element, and a drive means to drive the oscillating end, whereby the position of the guide means with respect to the recording element can be conveniently varied, and the image transfer material can be separated from the recording element by oscillating the guide means alone. In particular, since the guide means is in a symmetrical shape at both upstream and downstream sides thereof with respect to the image transfer position, the oscillating motion can be easily regulated. For the drive mechanism of the guide means, there may be exemplified an eccentric cam member which is rotated by a rotational driving source and a link mechanism which is driven by the cam member. The reason for using the rotational force as the driving source is that, since the quantity of displacement of the guide means can be arbitrarily established by adjusting the rotational quantity, the distance between the recording element and the guide means can be set as broadly as possible.

The abovementioned image transfer device, as one example of its use, can be so made that the guide means may be brought to a certain definite position at the time of its starting, and be further moved to a predetermined position by detecting the thickness of the image transfer material, or by an input from a selection switch. By setting the position of the guide means in this way, an operator can easily exchange the image transfer material, hence the range of application of the recording device can be made broader.

As mentioned in the foregoing, the image transfer device of the present invention is capable of imparting a predetermined uniform tension to the image transfer material by the guide means which guides the image transfer material to the recording element in accordance with conveyance and stoppage of the image transfer material as well as its thickness, and by the driving means which drives the guide means, whereby stability in conveyance of the image transfer material can be improved to realize favorable state of image transfer.

It is another object of the present invention to provide at a low cost an image transfer device capable of accurately setting the distance between the photosensitive member and the guide member at the image transfer position.

To attain this object, the present invention constructs the device for introducing the continuous web of image transfer material to its image transfer position in the form of a unit which is called a guiding unit. This guiding unit comprises a guide plate as a member for guiding the image transfer member to its image transfer position, means for applying a bias voltage for transferring an image onto the image transfer material, unit supporting means capable of setting the guiding unit at an arbitrary distance relative to an image bearing member, spacer means interposed between the unit and the image bearing member for setting the distance between them, and urging means to urge the guiding unit to the image bearing member depending on necessity. The spacer means may be a rotor which rotates between a non-image portion of the image bearing member and the guiding unit. By displacing the position between this rotor and the guiding unit, the contact state between the image bearing member surface and the image transfer material may be established arbitrarily.

DESCRIPTION OF THE PREFERRED EMBODIMENTS

Figure 1:
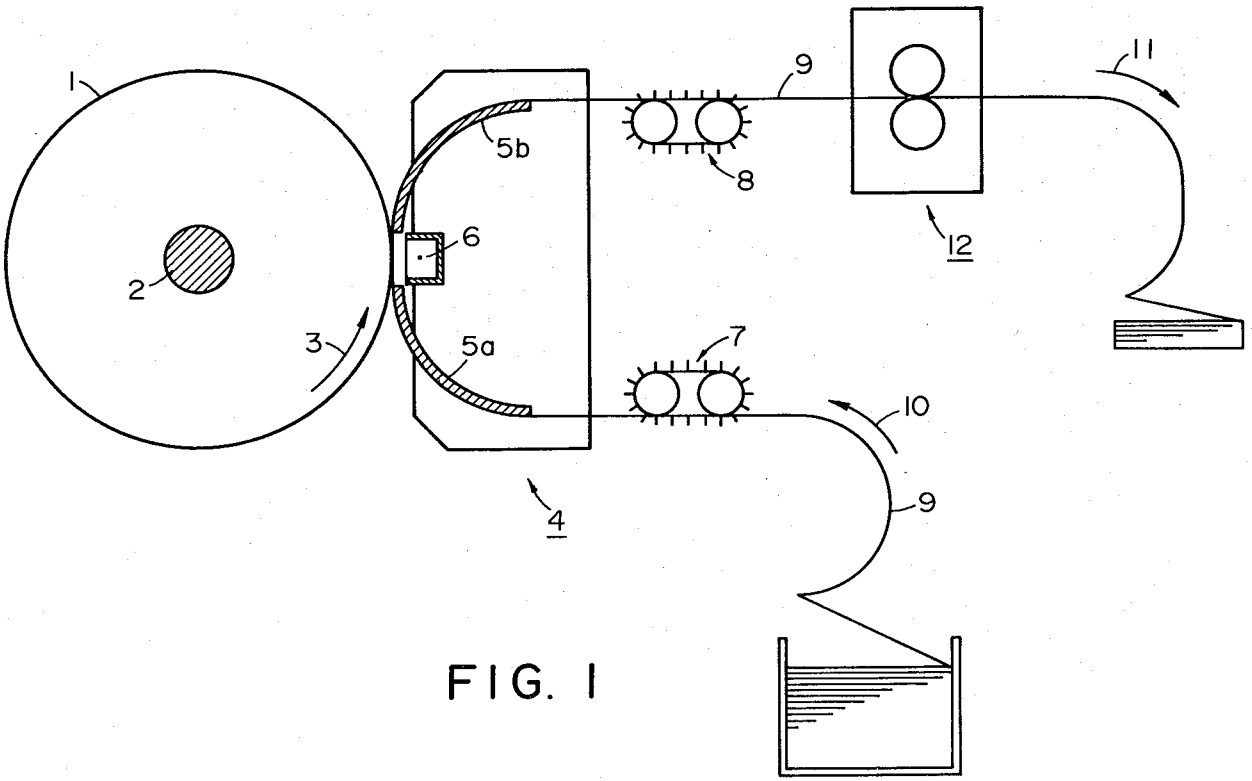
FIG. 1 is a schematic cross-sectional view of a printer using a continuous web of image transfer material.

FIG. 1 is a schematic cross-sectional view showing the flow of the image transfer material and a structure of the image transfer section of a non-impact printer capable of operating at a high speed. In the illustration, the other process mechanisms than this image transfer section are omitted for the sake of simplicity. In FIG. 1, a numeral 1 refers to a photosensitive drum as an information recording element. This photosensitive drum 1 is held on a rotary shaft, and rotates in the direction of an arrow 3. A unit 4 opposite to the drum 1 is the image transfer device having a pair of guide plates 5*a*, 5*b* and a corona discharger 6. Numerals 7 and 8 refer to tractors to convey the image transfer material, which convey a continuous web of image transfer material 9 as fanfolded in the direction of arrows 10, 11. The image transfer material 9 passes through the tractor 7, the guide plate 5*a*, the corona discharger 6, the guide plate 5*b*, the tractor 8, and an image fixing device 12 in the order as mentioned, and is conveyed by the tractors and other conveying means at a predetermined timing. As is apparent from FIG. 1, the positional accuracy of the guide plates 5*a*, 5*b* constitutes one of the factors which govern the result of the image transfer operation.

Figure 2:
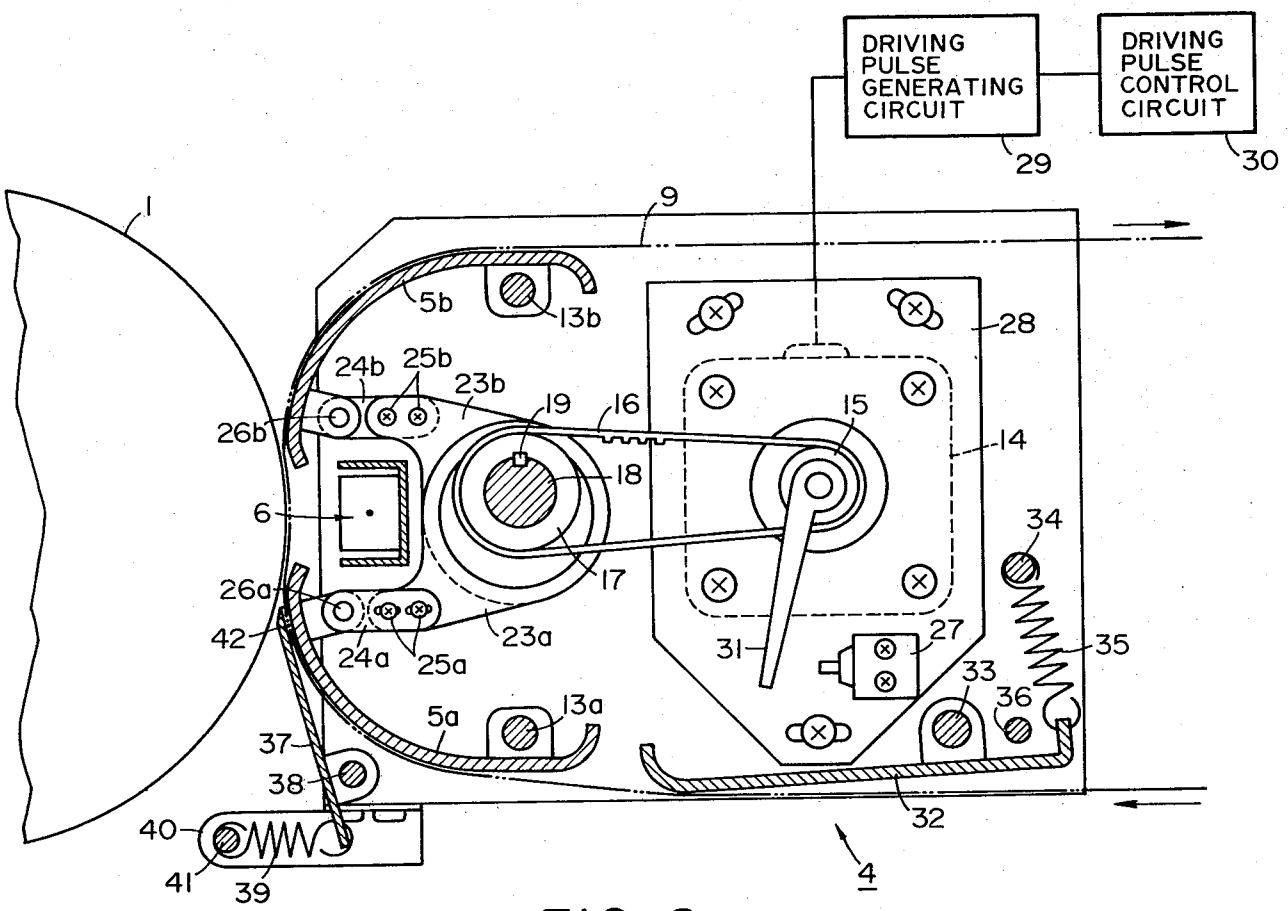
FIGS. 2 and 3 are respectively longitudinal cross-sectional views of one embodiment of the image transfer device according to the present invention.
Figure 3:
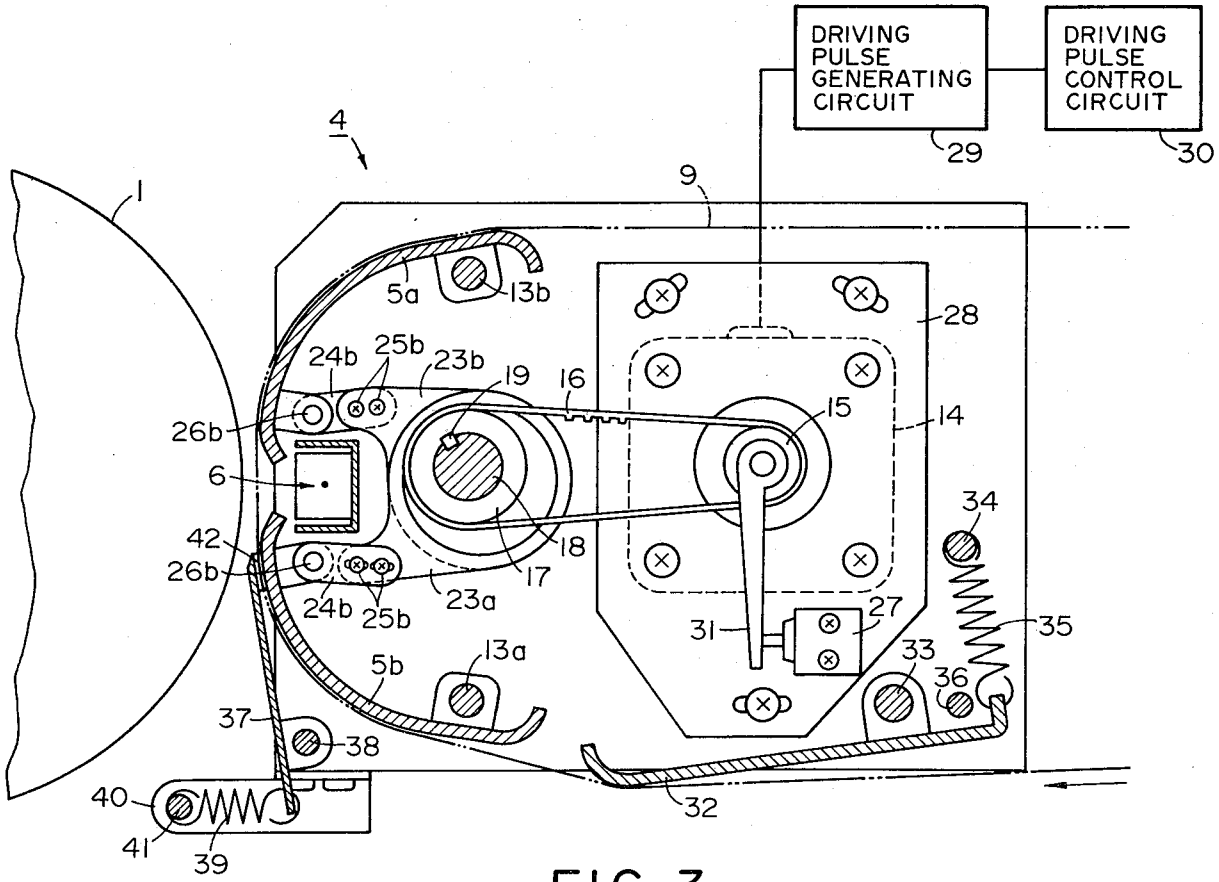
Figure 4:
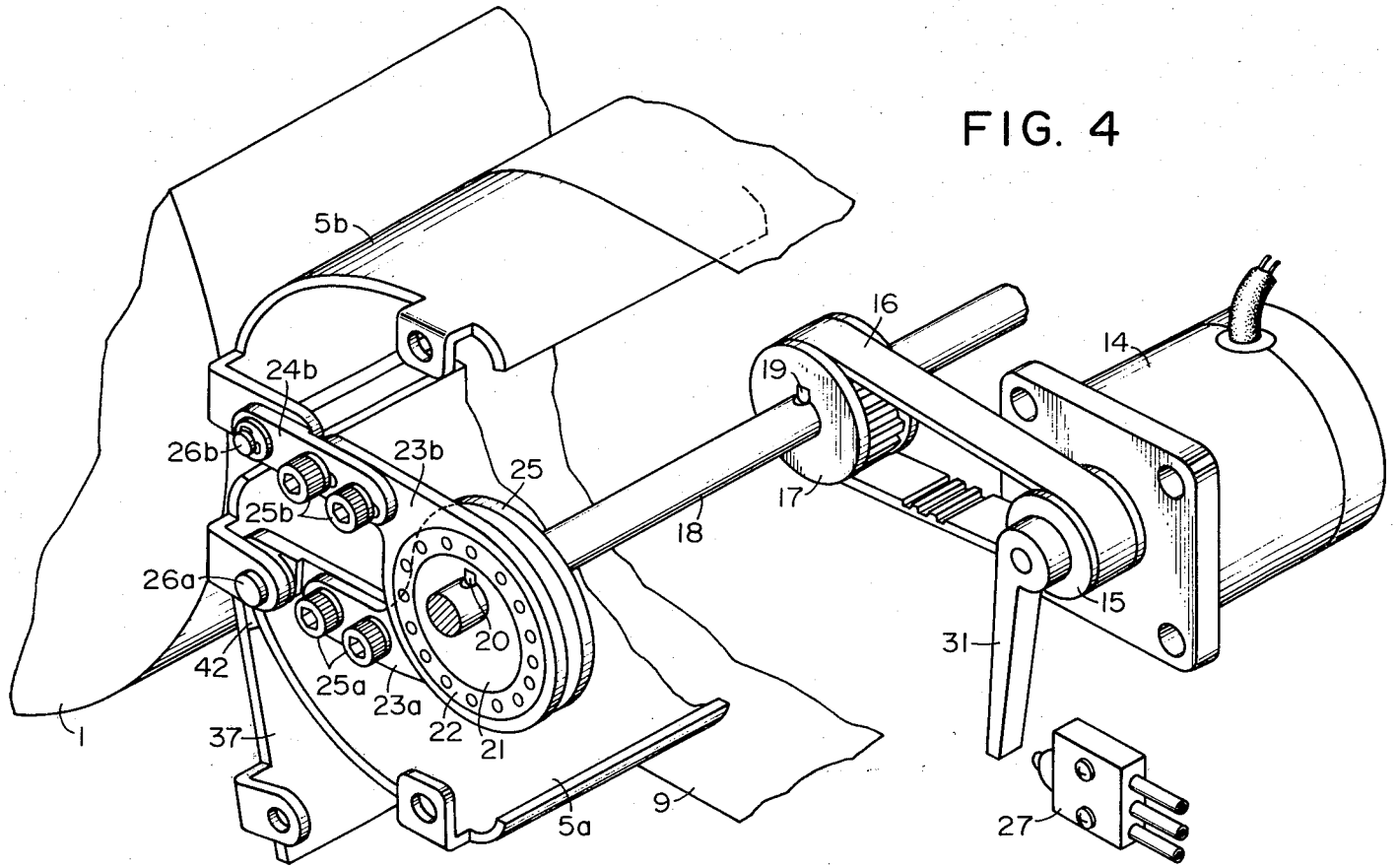
FIG. 4 is a perspective view of the image transfer device shown in FIG. 2.

FIGS. 2 and 3 are respectively longitudinal cross-sectional views schematically showing one embodiment of the image transfer device according to the present invention, and FIG. 4 is a perspective view of the device shown in FIG. 2. In the drawing, a reference numeral 1 designates the photosensitive drum, 4 refers to the image transfer device, and 5a, 5b the guide plates. The guide plates 5a, 5b have their respective oscillating center shafts 13a, 13b at one end part thereof. The other end part of these plates are set at positions closer to, or distant from the drum 1 by means of a driving mechanism provided on each of them. Details of the driving mechanism will be given in the following paragraphs.

The driving mechanism consists of a driving source and an operating section. The driving source uses a motor 14 such as a pulse motor, stepping motor, and so forth, which rotates a certain definite amount by a predetermined signal, and drives the operating section by a toothed belt 16 extended between toothed pulleys 15, 17. The pulley 17 is fixedly provided on a shaft 18 by means of a key 19 as the left side of the operating section for the key-fixed construction, vide FIG. 4). When the pulley 17 rotates, the shaft 18 is driven accordingly. At both ends of the shaft 18, there are fixedly provided eccentric cams 21 by keys 20. On the outer periphery of the eccentric cam, two eccentric links 23a, 23b are mounted through a ball bearing 22. Adjusting links 24a, 24b each having long slots are fixed at the tip end parts of the respective links 23a, 23b by threaded screws 25a, 25b. On the respective links 24a, 24b to the side of the guide plates 5a, 5b, there are fixed a part of the guide plates 5a, 5b in a freely oscillatable manner through respective pins 26a, 26b.

In more detail, the eccentric links 23a, 23b are engaged with the drive shaft 18 through the ball bearings 22 and the eccentric cams 21 to operate the guide plates 5a, 5b in accordance with a rotational angle of the drive shaft 18. Driving force to the drive shaft 18 is generated by the drive motor 14, which is transmitted through the toothed belt 16 and the toothed pulleys 15, 17. In view of the fact that the drive motor 14 frequently repeats its forward and reverse rotation, the tooth shape of the pulleys 15, 17 should desirably be of a back-lashless type. On the other hand, in order to improve the rectilinearity and parallelism in the guide surface of the image transfer material, a bending work is effected at the tip end part of the guide plates 5a, 5b, in particular, in the vicinity of the image transfer section. On account of this, twisting tends to be developed in the guide plates 5a, 5b, hence their mechanical precision is low.

Therefore, in case a set of guide plates 5a, 5b are connected with corresponding links 24a, 24b, as mentioned above, the distortion in the guide plates is recitified until they become parallel with the drum 1, and then connected parts between the adjusting links 24a, 24b and the eccentric links 23a, 23b are fixed in this rectified state with a stopper screws, whereby the mechanical precision in the guide plates 5a, 5b and other component members can be improved. In addition, a micro-switch 27 is fixed to a fitting plate 28 by a stopper screw in the vicinity of the drive motor 14. The drive motor 14 is subjected to rotation by signals from a drive pulse generating circuit 29 and a drive pulse control circuit 30. The number of pulse generations and the pulse frequency which determine the driving direction (forward or reverse rotation) and rotational quantity of the rotational shaft are appropriately selected in the drive pulse control circuit 30 in accordance with the thickness of the image transfer material and other conditions. The drive motor 14 is driven by an output from the pulse generating circuit 29. Immediately after closure of the power source, if the drive motor 14 is not at a predetermined position, i.e., if the guide plates are not in a definite state, these guide plates 5a, 5b should be reinstated by rotating the motor to a position where a switch lever 31 mounted on the rotational shaft of the motor 14 actuates the micro-switch 27. Incidentally, the micro-switch 27 may be substituted by a rotary encoder, a potentiometer, and others.

In FIGS. 2 and 3, a reference numeral 32 designates a buffer plate which renders uniform the tension in the image transfer material at the image transfer section to prevent any slackening from taking plate. The buffer plate 32 is supported on a rotational shaft 33 in a rotatable manner, and is so energized as to rotate counterclockwise by a spring 35, one end of which is fitted on a spring hooking shaft 34. A numeral 36 refers to a stopper to regulate a quantity of oscillation of the buffer plate 32. Therefore, the buffer plate 32 can be replaced by a leaf spring and other spring material which is subjected to elastic deformation.

On the other hand, a separator plate 37 is provided in the vicinity of the drum 1, which guides the image transfer material to the drum 1, and, at the same time, assists peeling the image transfer material off the drum 1. A numeral 38 refers to an oscillating shaft for the separator plate 37, and 39 refers to a spring which pulls the separator plate 37 in the clockwise direction. The spring 39 is fixed to a spring hooking shaft 41 mounted on a fixed plate 40 which is turn is fixedly provided at one part of the image transfer device. Further, a spacer 42 is fitted at one end part of the separator plate 37 to the side of the guide plate 5a, whereby the separator plate 37 is urged toward the guide plate 5a by the tension spring 39 through the spacer 42. By the way, a gap between the separator plate 37 and the guide plate 5a is determined by a thickness of the spacer 42. By setting the thickness of the spacer 42 equal to the maximum thickness of the image transfer material, or larger than that, the peeling function of the separator plate 37 improves, and, at the same time, any hindrance to the image transfer material 9 under conveyance is prevented.

In the following, difference between FIG. 2 and FIG. 3 will be explained.

FIG. 2 shows the image transfer material 9 in its state of being conveyed, while FIG. 3 indicates its stoppage. In FIG. 2, the driving motor 14 rotates forwardly for predetermined numbers of pulses corresponding to the thickness of the image transfer material, and then stops. Accordingly, the guide plates 5a, 5b come closer to the side of the drum 1 so as to dispose the image transfer material in contact with the surface of the drum 1 to be ready for the image transfer thereonto. In FIG. 3, the driving motor 14 rotates in the reverse direction for predetermined numbers of pulses corresponding to thickness of the image transfer material, returns to a position where the micro-switch 27 becomes actuable, and stops. Accordingly, the guide plates 5a, 5b leave away from the drum 1, thereby separating the image transfer material 9 from the surface of the drum 1 to bring it into an incapable state of the image transfer.

From the foregoing explanations, it has become apparent that the guide plates 5a, 5b are capable of bringing the image transfer material 9 in close contact with, or away from, the drum 1 without moving the entire image transfer apparatus, depending on whether the image transfer material 9 is in the state of its conveyance or in stoppage. Therefore, in reference to FIGS. 5 and 6, explanations will be given as to movement of the guide plates 5a, 5b to their optimum positions in accordance with thickness of the image transfer material to be used at the time of the image transfer operation.

Figure 5:
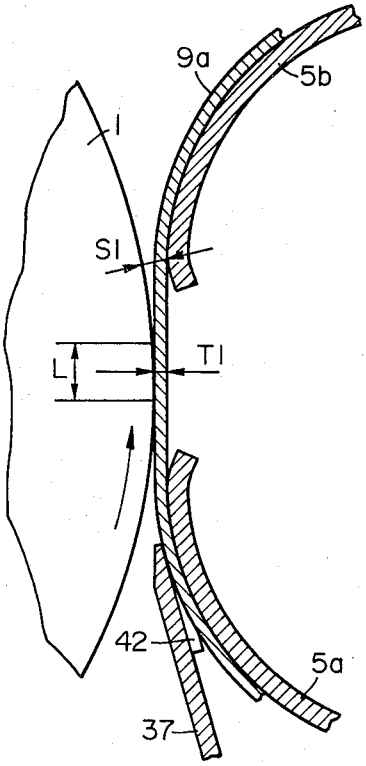
FIGS. 5 and 6 are respectively enlarged, cross-sectional views of the image transfer section of the image transfer device according to the present invention.
Figure 6:
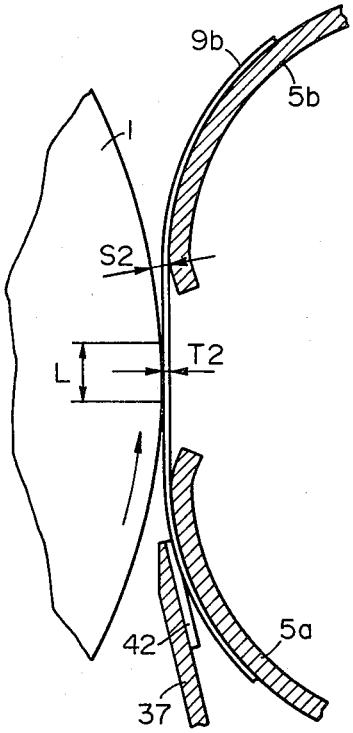

FIG. 5 indicates a case where a thick image transfer material is used, while FIG. 6 indicates a case where a thin image transfer material is used. In FIG. 5, the image transfer material 9a is a sheet of paper having a thickness of T1, the upper guide plate 5b is held in stoppage in proximity to the drum 1 with a distance S1, and the surface of the image transfer material 9a facing the side of the drum 1, at this time, contacts the drum 1 to be ready for the image transfer. In FIG. 6, on the other hand, the image transfer material 9b is a sheet of paper having a thickness of T2, the upper guide 5b is in stoppage in proximity to the drum 1 with a distance S2, and the surface of the image transfer material 9b facing the side of the drum 1 contacts its surface to be ready for the image transfer, as is the case with FIG. 5. In both FIGS. 5 and 6, when a high tension voltage is applied to the corona discharger 6 shown in FIGS. 2 and 3 at the time of the image transfer operation, the image transfer materials 9a, 9b are electrostatically attracted to the side of the drum 1, and contact thereto at a region L. Therefore, the image transfer material can always be in contact with the drum at a certain definite image transfer region irrespective of the thickness of the image transfer material.

As stated in the foregoing, when the image transfer material is in conveyance or in stoppage, the image transfer device according to the present invention displaces the guide means for guiding the image transfer material to a desired position in correspondence to the thickness of the image transfer material, and, at the same time, secures the positional accuracy of the guide means relative to the drum, and imparts an appropriate tensile force to the image transfer material, depending on necessity, whereby the image transfer material travels and stops through a predetermined path with desired stability, and high stable image transfer can be effected. Therefore, the image transfer device of the present invention is capable of performing favorable and satisfactory information recording with high image quality.

In the following, another embodiment of the image transfer device according to the present invention will be described.

Figure 7:
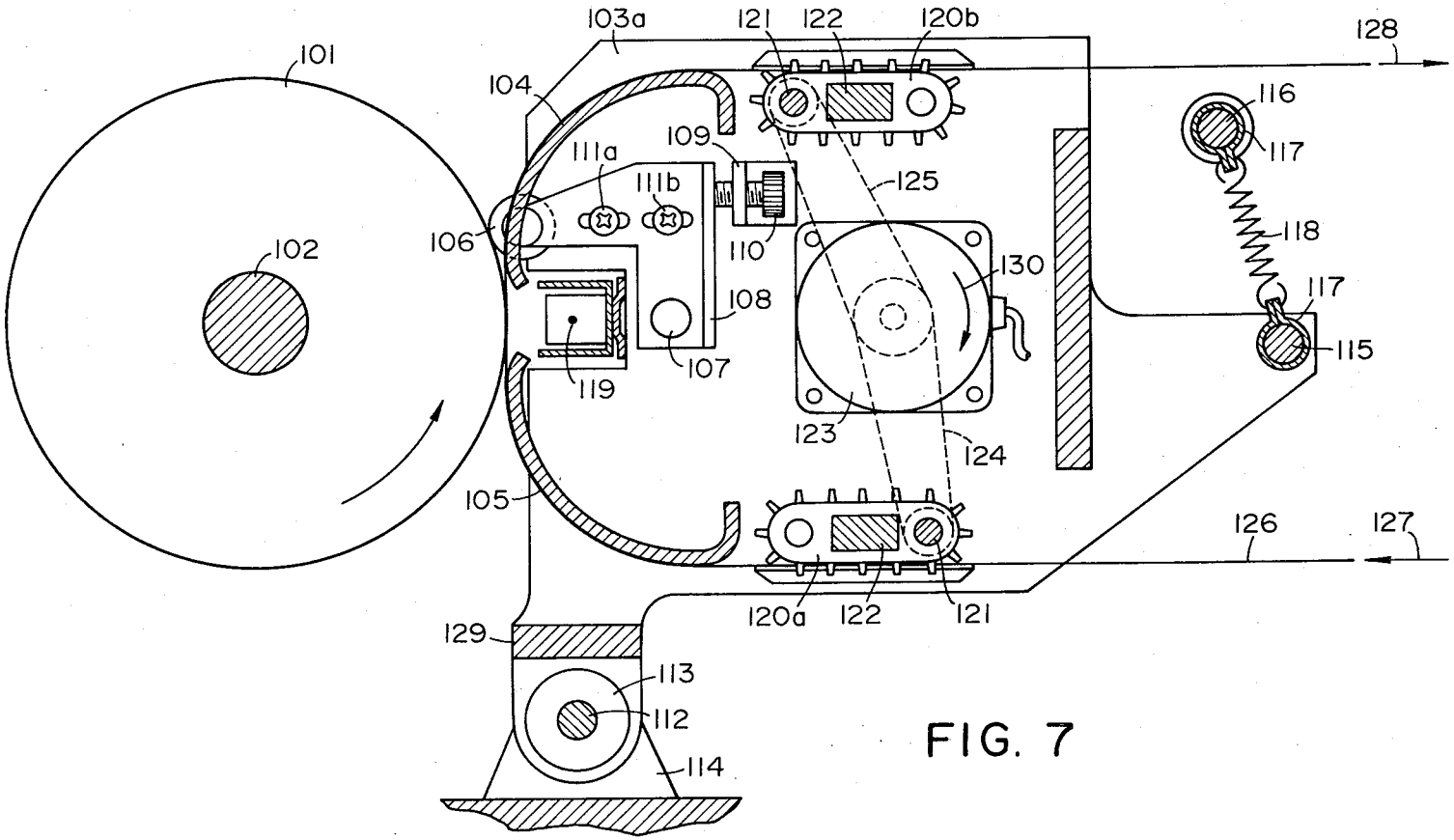
FIG. 7 is a longitudinal cross-sectional view of another embodiment of the image transfer device according to the present invention.
Figure 8:
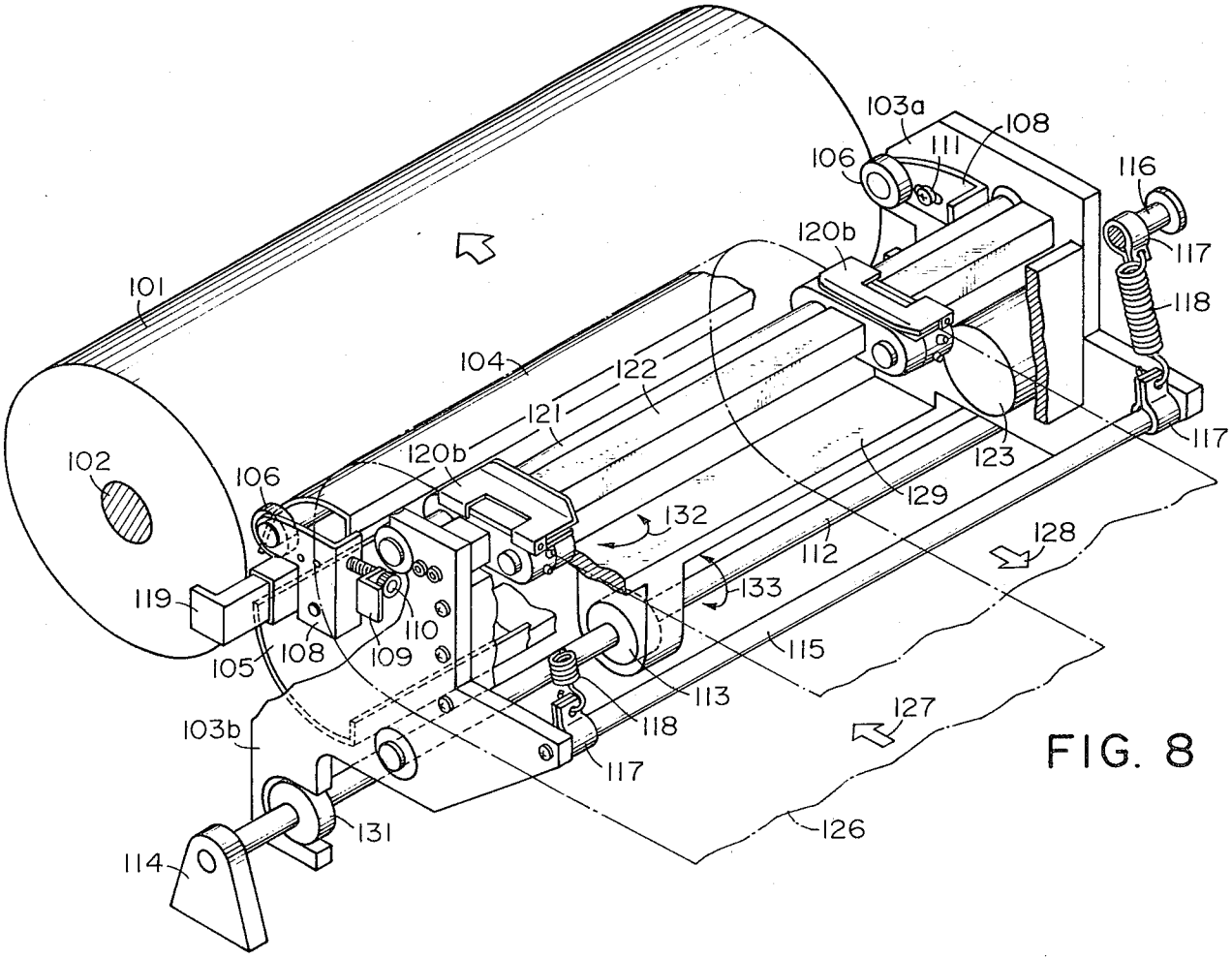
FIG. 8 is a perspective view of the image transfer device shown in FIG. 7.

FIG. 7 is a cross-sectional view of the guiding unit in the image transfer device according to the present invention, in which the relationship between the unit construction and the photosensitive body is illustrated. FIG. 8, on the other hand, is a perspective view of the image transfer device in FIG. 7, wherein the same component parts are designated by the same reference numerals. It is to be noted that, in these figures of the drawings, no processing mechanisms at the side of the main body of the apparatus are shown, but the neighborhood region of the image transfer section is shown alone.

In the drawing, 101 refers to a drum-shaped photosensitive member which is supported on a rotational shaft 102 through a bearing, and is rotated in the direction of an arrow mark by a driving means (not shown). 103a, 103b designate side plates of the guide unit, of which the side plate 103a constitutes the rear side plate, and the side plate 103b constitutes the front side plate (vide FIG. 8). 104, 105 refer to guide plates as the guiding members for the image transfer material, of which the guide plate 105 constitutes the entrance side guide plate, and the guide plate 104 constitutes the exit side guide plate. Both guide plates are given a certain determined curvature, and fixed to the abovementioned side plates. The image transfer material is conveyed along these guide plates 105, 104 as shown in the drawing.

In the following, explanations will be given as to the unit support means capable of arbitrarily moving the abovementioned guiding unit with respect to the photosensitive body.

The abovementioned side plates 103a, 103b are supported in parallel by means of guide shafts 122 for tractors 120a, 120b extending in the same direction as that of the shaft 102 for the photosensitive drum 101, a lower staying member 129, and so forth. In a projected part of this stay 129 at its center, there is fixed an outer ring of an automatic center adjusting ball bearing 113 whose inner ring is fixed onto a fixed supporting shaft 112. On the other hand, the supporting shaft 112 is fixed on a mounting member 114 at the side of the base of the main body. At least on one side of the shaft 112, there is provided a roller 131 such as ball bearing, etc., the inner ring of which is fitted thereon. The roller 131 is fitted in a recess formed in the side plate 103a (103b) to support the side plate.

By the abovementioned construction, the guide unit, the main part of which is accommodated in the side plates 103a, 103b, can be rotated substantially horizontally in the direction of an arrow 132 by the roller 131, and in the direction of an arrow 133 with the shaft 112 as the center of rotation by the ball bearing 113.

A distance between the photosensitive member and the guiding unit due to the abovementioned unit supporting means is secured or adjusted by the spacer means to be described in the following.

In the drawing, 106 refers to a roller constituting a part of the spacer means. The roller 106 is a ball bearing, etc., supporting on a mounting plate 108, and rotates on the surface of the photosensitive drum 101. The abovementioned mounting plate 108 is disposed rotatably with a shaft 107 as the center. By moving back and forth an adjusting screw 110 fitted on a supporting plate 109 which in turn is fixed to the side plate, the mounting plate 108 is rotated for its adjustment. Incidentally, the side plates 103a, 103b are rotatably supported on the shaft 112, as mentioned in the foregoing, and they are further energized by a spring 118, which is an urging means, to constantly rotate counterclockwise (in the case of FIG. 7). In other words, the driving force to rotate the slide plates 103a, 103b in the abovementioned manner is derived by hooking the spring 118 on a spring hooking stay provided on the side plates 103a, 103b and a spring hooking member mounted on a hooking shaft 116 fixed onto the side of the main body.

By the above-described construction, the guide unit tends to rotate counter-clockwise with the shaft 112 as the center of its rotation, the rotational quantity of which is determined by contact of the roller 106 with the photosensitive member 101. In order, therefore, to set a distance between the guide plates 104, 105 and the photosensitive member 101, the stopper screws 111a, 111b are loosened, and the forwarding quantity is established by these screws, after which the stopper screws 111a, 111b are again tightened. Since the guide unit moves in correspondence to the surface of the photosensitive member 101, the distance between the photosensitive member and the image transfer member can be set, once the abovementioned distance between the guide plates and the photosensitive member has been set.

In the drawing, reference numerals 120*a*, 120*b* designate tractors to convey a continuous web of image transfer material. In particular, the tractor 120*a* constitutes an inlet tractor (not shown in FIG. 2), and the tractor 120*b* constitutes an outlet tractor. Numerals 121*a*, 121*b* refer to spline-drive shafts for the tractors, 122*a*, 122*b* guide shafts for the tractors 123 a drive motor for the tractors 124, 125 toothed driving belts for the tractors 120*a*, 120*b*, and 130 an arrow mark showing a rotational direction of the drive motor 123. A numeral 126 refers to the image transfer material which passes through the inlet tractor 120*a*, the guide plate 105, the guide plate 104, and the outlet tractor 120*b*. In more detail, as soon as the drive motor 123 starts rotation in the arrow direction 130, the tractors 120*a*, 120*b* begin to convey the image transfer material in the arrow direction through the toothed belts 124, 125, whereby the image transfer material 126 is moved in the arrow direction. A numeral 119 refers to a corona charger which applies a bias voltage for transfer of a toner image formed on the photosensitive member onto the image transfer material 126.

According to the abovementioned construction, therefore, the image transfer unit constituting the image transfer device of the present invention follows variations in the photosensitive surface due to the action of the tension spring 118 or force against such tensioning force, thereby maintaining the contact state between the photosensitive member 101 and the roller 106. As the result of this, the distance between the surface of the photosensitive member 101 and the guide plates 104, 105 is always maintained constant, and the image transfer material 126 is stably held at the image transfer position to be able to continuously travel in the tangential direction of the photosensitive member 101. Further, when the tractor for forwarding the image transfer material is provided at the closest possible position to the sides of the inlet and outlet with the image transfer section therebetween, a length of the image transfer material 126 extended between the tractors 120*a*, 120*b* is determined definite, hence the image transfer material 126 becomes neither slackened nor damaged due to excessive tension being applied thereto, even when the unit moves in pursuance, of the photosensitive member 101.

As stated above, in the above-described embodiments of the image transfer device according to the present invention, the distance between the photosensitive member and the image transfer unit is always maintained constant to be able to stably convey the continuous web of the image transfer material. On account of this, the image transfer material can always be contacted with the surface of the photosensitive member in a certain definite state, and the image transfer operation can be carried out in a stable manner, whereby satisfactory transferred image of high image quality can be obtained.

Incidentally, it is to be noted that the drum-shaped photosensitive member is used in the above-described device as the image carrying member, but this is not so restrictive, and there may be used other types of drum such as insulative drum, magnetic drum, and so forth which are capable of carrying images thereon. Further, the image carrying member is not limited to the drum-shape, but it may in a web-form to be conveyed over the photosensitive member 101 in FIG. 1. Furthermore, the image transfer unit in the above-described embodiments is urged to the image carrying member by the spring 118, although it may be feasible to urge the image transfer unit to the image carrying member in utilization of a balance in the unit per se, and without use of the spring 118. This is made possible by providing the shaft 112 at the right side in FIG. 7.

What we claim is:

1. An image transfer device for transferring an image from an information recording element, said device comprising:

means for transferring an image from the information recording element to a transfer material, at an image transfer station;

means for feeding the transfer material to said transfer means;

symmetrically arranged transfer material guiding members extending along a transfer material path, each having a first end portion which is remote from said transfer means and a second end portion which is near said transfer means, said first end portion being pivotable to allow the setting, in accordance with the thickness of the transfer material, of the distance between the second end portion and the information recording element at the image transfer station;

driving means, engaged with each of said guiding members adjacent the second end portion thereof, for moving only the second end portions away from the recording element, wherein each guiding member, when said feeding means is not in operation, is away from the information recording element; and biasing means for applying resilient tension to the transfer material to ensure that the transfer material is spaced apart from the information recording element when said driving means moves said guiding members away from the information recording element.

2. A device according to claim 1, wherein said driving means includes a single eccentric cam.

* * * * *